US005152210A

United States Patent [19]

Chen

[11] Patent Number: 5,152,210

[45] Date of Patent: Oct. 6, 1992

[54] MODULIZED WATER AND LIGHT PERFORMING EQUIPMENT

[76] Inventor: Tu W. Chen, 1F, No. 32 Lane 42, Tong-Kwang Rd., Hsin-Chu 30041, Taiwan

[21] Appl. No.: 620,014

[22] Filed: Nov. 30, 1990

[51] Int. Cl.[5] ..... A63J 17/00; E03B 9/20; F21P 7/00

[52] U.S. Cl. ..... 84/464 R; 239/16; 239/18

[58] Field of Search ..... 84/464 R; 239/16, 17, 239/18; 137/624.11

[56] References Cited

U.S. PATENT DOCUMENTS 4,376,404 3/1983 Haddad ..... 84/454 R
4,844,341 7/1989 Alba ..... 239/18

*Primary Examiner*—Russell E. Adams
*Assistant Examiner*—Jae Noh

[57] ABSTRACT

A modulized water and light performing equipment comprised of water pump and water distribution and level controller and controlled by a circuit sub-system according to built-in procedure, external sound and external specific signal input modes, to produce various spring patterns of different heights changing at different tempo and rhythm. A plurality of colored lamps are controlled by the circuit sub-system to produce color lighting effects harmoniously matching with water performance. Water performance sub-system and light performance sub-system are incorporated to produce various harmonious, color spring patterns according to the signals sent from different input modes.

15 Claims, 6 Drawing Sheets

MODULIZED WATER AND LIGHT PERFORMING EQUIPMENT

BACKGROUND OF THE INVENTION

The present invention relates to water and light performing equipment, and more particularly relates to a modulized water and light performing equipment which provides various spring patterns matching with harmonious color lighting effects through modulized control.

Regular big scale music spring performing equipment can produce a variety of spring patterns according to the playing of a music. This type of water performing equipment is very expensive and requires much space to build up. The construction and water piping are very complicated. Further, only professional people can manage suitable spring patterns to match with selected music.

There is still some other kinds of spring generating equipment of relatively smaller scale for decoration. However, they required complicated water piping incorporating with a plurality of separate water nozzles disposed at different locations and angles for generating different spring patterns. In these structures, one water pump is provided for generating a specific spring pattern. When several spring patterns are to be generated, several water pumps are required and much space will be occupied. During performance, spring patterns can only be changed in height in accordance with the change of the frequency or volume of a music, i.e. little variation can be provided and the spring patterns that are generating can not express the main theme of a music.

In U.S. Pat. No. 4,376,404 there is disclosed a device to convert voice into spring pattern controlling signal for controlling a water performing equipment to generate different spring patterns. It analyzes a music to obtain relative voltage level corresponding to the beat and frequency band width of a music, so as to proportionally control the output of water through the nozzles. This structure still can not express the main theme of a music and can only change the size of the spring generated.

SUMMARY OF THE INVENTION

The present invention has been accomplished to eliminate the aforesaid problems. According to one aspect of the present invention, a modulized water distribution and level controller is provided to control a single water pump to pump water for generating various spring patterns at the same time. According to another aspect of the present invention, a spring pattern generating unit is provided to produce a variety of spring patterns without using nozzles of different ejecting angle. According to still another aspect of the present invention, a plurality of modulized water distribution and level controller and water pattern generating units are incorporated to present a variety of three-dimensional spring patterns. According to still another aspect of the present invention, a modulized water and light performing equipment can be alternatively controlled to operate through three input modes including built-in procedure, external sound and external specific signal. Therefore, no professional engineer is required in selecting background music. Modern sound analysis theory is applied in the present invention so that different spring patterns are controlled to play in accordance with the tendency of sound when external sound control mode is selected. A light performance unit is provided to generate different color lighting at different intensity so as to harmonize with the various spring patterns generated through a water performance unit.

BRIEF DESCRIPTION OF THE DRAWINGS

The present invention will now be described by way of example only, with reference to the annexed drawings, in which:

FIG. 4 illustrates the structure of the light performance sub-system according to the present invention.

DETAILED DESCRIPTION OF THE PREFERRED EMBODIMENT

Figure 1:
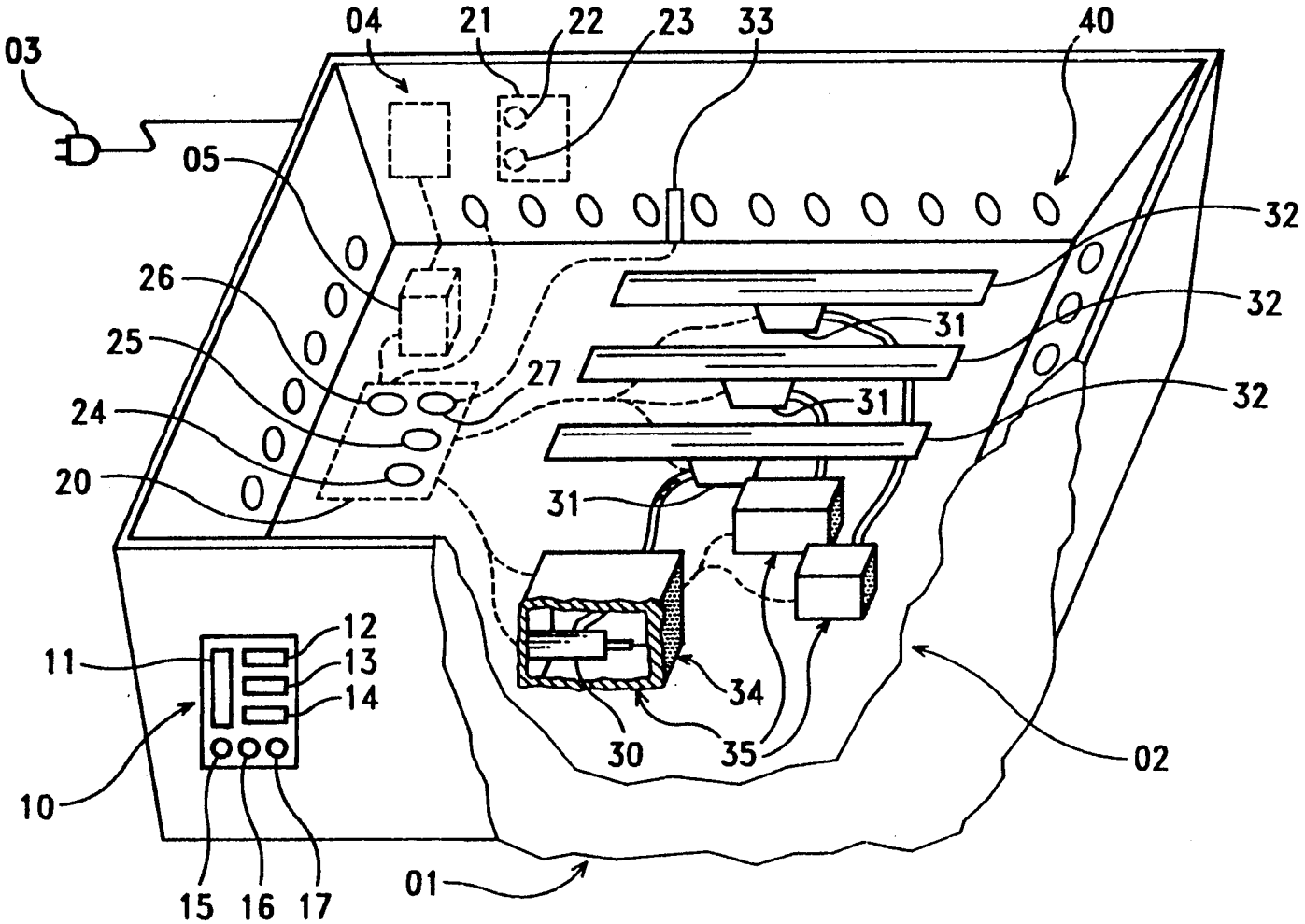
FIG. 1 illustrates the complete system of the preferred embodiment of the present invention.

Turning now to be annexed drawings in greater detail and referring first to FIG. 1, therein illustrated is a modulized water and light performing equipment embodying the present invention and generally comprised of a bottom box unit 1 and a top box unit 2. The bottom box unit 1 comprises a power supply unit 3~5, a front control panel 10 and a main circuit unit 20. The top box unit 2 comprises a water performance sub-system 30~35 and a light performance sub-system 40.

In the preferred embodiment of the present invention, the power supply unit 3~5 provides the whole system of the present invention with necessary working voltage, which comprises an AC power input cable 3, a power switch 4 and a transformer 5. The front control panel 10 comprises selector switches 11 through 14, light emitting diodes 15 and 16 for warning display, and a photoresistance (CDS sensor) 17. The selector switch 11 is to select either of the three input modes of built-in procedure, external sound or external specific signal, for alternatively controlling the operation of the main circuit unit 20.

The main circuit unit 20 is selectively controlled by the built-in procedure input mode, the external sound input mode and the external specific signal input mode. When the built-in procedure input mode is selected, the main circuit unit 20 provides built-in procedure signal sets to control the water performance sub-system 30~35 and the light performance sub-system 40 via relay switches 24 and 25, and relay switch 26 respectively, so as to present various spring patterns harmoniously matching with a variety of lighting effects including the change of color lighting, height of spring, intensity of light, tempo and rhythm. When the external sound input mode is selected, the main circuit unit 20 receives analog signal from external sound via an audio input terminal 22 on a back panel 21, to sample and analyze sound tendency, then determine the significance of external sound so as to provide selected logic procedures, according to the tendency of external sound, for controling the water performance sub-system 30~35 and the light performance sub-system 40 via the relay switches 24 and 25, and the relay switch 26, to respectively present various spring patterns harmoniously matching with different color lighting and intensity of light, different tempo in ejecting water at different rhythm. When the external specific signal input mode is selected, the main circuit unit 20 receives digital control signal from external specific signal via the input terminal 23 of the back panel 21 to control the water and light performance sub-systems 30~35 and 40 via the relay switches 24, 25 and 26 (details of the main circuit unit 20 will be outlined further).

Under either of the aforesaid three different input modes, an user can control the water function selector switch 12 to turn on/off water performance; control the light function selector switch 13 to turn on/off light; let the photo sensor 17 to control the intensity of light according to ambient brightness; or control the tempo selector switch 14 to determine the rate of speed in counting water and light performance patterns under built-in procedure input mode.

The power supply unit 3~5 and the front control panel 10 are of the known art (selector switches, transformer, light emitting diodes, photo sensor are of general electronic components) are respectively connected to the main circuit unit through regular technique.

As described above, the top box unit 2 comprises a water performance sub-system 30~35 and a light performance sub-system 40, the structure of which is outlined hereinafter. Referring to FIG. 1 again, the water performance sub-system 30~35 is comprised of three AC operated submersible pumps 30, three water distribution and level controllers 31, three spring pattern generating units 32, an water level sensor 33, a plurality of filter sponges 34 and reservoirs 35. The water performance sub-system 30~35 receives control signal from the main circuit unit 20 via the relay switch 24 to drive the AC operated submersible pumps 30 to respectively pump or stop pumping water, and simultaneously to drive the water distribution and level controllers 31 to respectively supply a predetermined amount of water to a certain water intake at the spring pattern generating units 32. Therefore, the function in controlling water spring patterns and water level is achieved (details of performance will be described further). The filter sponges 34 of the water performance sub-system 30~35 suck spring water back to the reservoirs 35 for further circulation through the operation of the submersible pumps 30. When water level drops below a predetermined range, the water level sensor 33 immediately sends a signal to drive the main circuit unit 20 to stop the water and light performance sub-systems and simultaneously to trigger the light emitting diodes 15 and 16, and to give an audio warning signal.

Figure 2:
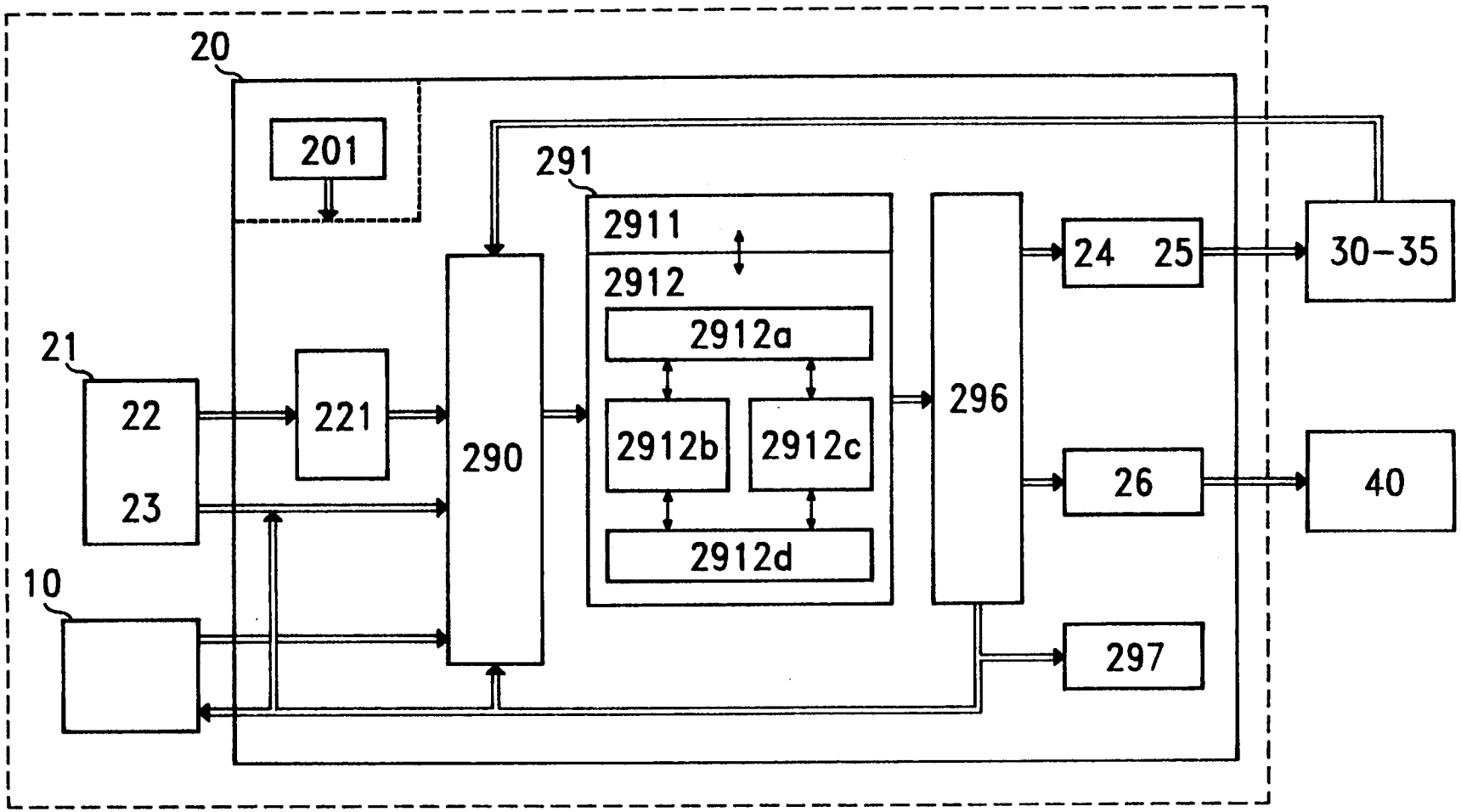
FIG. 2 is a circuit block diagram of the circuit sub-system according to the present invention (including front control panel, back control panel, main circuit unit)
Figure 2A:
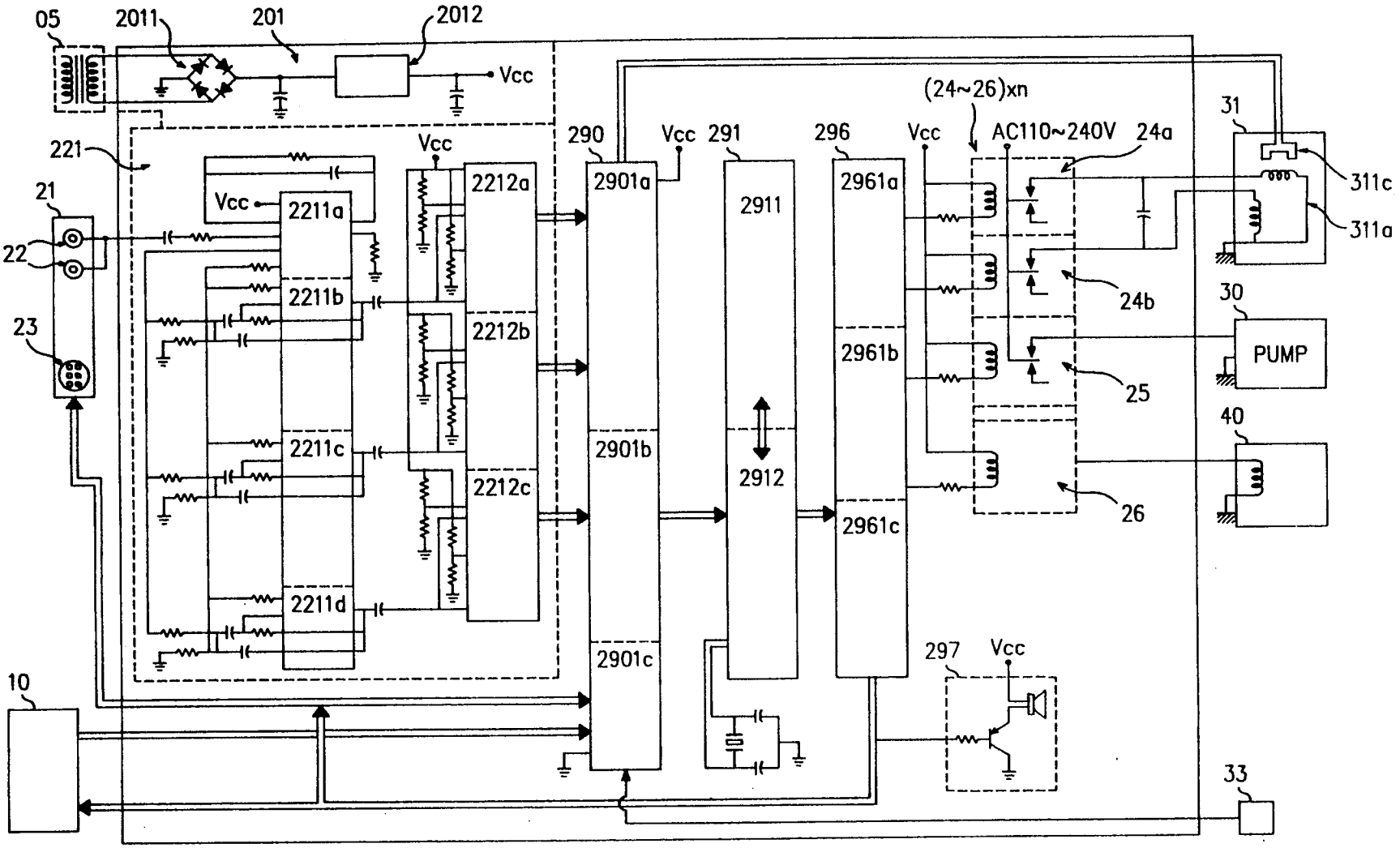
FIG. 2A is a circuit diagram of the main circuit unit of the circuit sub-system illustrated in FIG. 2.

FIG. 2 is a circuit block diagram of a circuit sub-system 10, 20, 21 according to the present invention. FIG. 2A is a circuit diagram of the main circuit unit 20 of the circuit block diagram of the circuit sub-system illustrated in FIG. 2.

As illustrated, rectifier circuit 201 comprises a bridge rectifier 2011 and a transformer IC 2012 to rectify and stabilize the power supply from the transformer 5 so as to provide a stable power voltage for the whole system of the present invention. The audio input terminal 22 of the back panel 21 receives external analog audio signal for processing into high, medium and low frequency bands through the operation of an operational amplifier 2211 of a sound analyzer circuit 221, and then compared through another operational amplifier 2212 to further send to a TTL (transistor-transistor logic) input driving IC 2901. The specific signal input terminal 23 of the back panel 21 receives specific digital control signal to directly send to the TTL input driving IC 2901, permitting a main control circuit 291 to control the present system or feed back a signal to the external specific signal transmitter. The TTL input driving IC 2901 also receives functional selection signals from the front control panel 10 to drive the main control circuit 291 to operate. The main control circuit 291 is comprised of a central processing unit (CPU) 2911 and a read only memory (ROM) 2912 to control the operation of the present system according to the program stored at the read only memory 2912.

When a built-in procedure mode is selected, the main control program procedure 2912*a* automatically picks up a selection logic procedure 2912*d* from a built-in program procedure 2912*b* through random access. The selection logic procedure 2912*d* is to select a harmonious signal sets from a data bank of spring patterns, colors of light, height of spring, intensity of light, rate of speed and rhythm, according to logic operation and probability theory for output of control signal through the main control program procedure 2912*a*.

When a sound input mode is selected, the sound tendency determination procedure 2912*c* determines the tendency of the input sound for controlling the operation of the present system, the detail of which will be outlined further.

A flip-flop output IC 2961 receives water and light sub-system control signal from the main control circuit 291 to control the synchronous motors 311*a* of the water distribution and level controllers 31 to rotate forward or backward via the relays 24*a* and 24*b*; to control the pumps 30 to pump or stop pumping water via the relay 25; to turn on/off various lamp bulbs of different color via the relay 26.

The TTL input driving IC 2901 also receives feedback signal from the water level sensor 33 so as to drive the main control circuit 291 to provide warning signal when water level is below a predetermined range, and from which the photo interrupter 311*c* sends back location signals. Thereafter, the flip-flop output IC 2961 triggers the buzzer 297 and the light emitting diodes 15 and 16 of the front control panel to operate. During changing of ambient intensity of light, the photo sensor 17 sends a detected signal to the TTL input driving IC 2901 to drive the main control circuit 291 to determine if to provide a control signal for controlling the light performance sub-system 40 according to the condition of the light function selector switch 13.

Figure 2B:
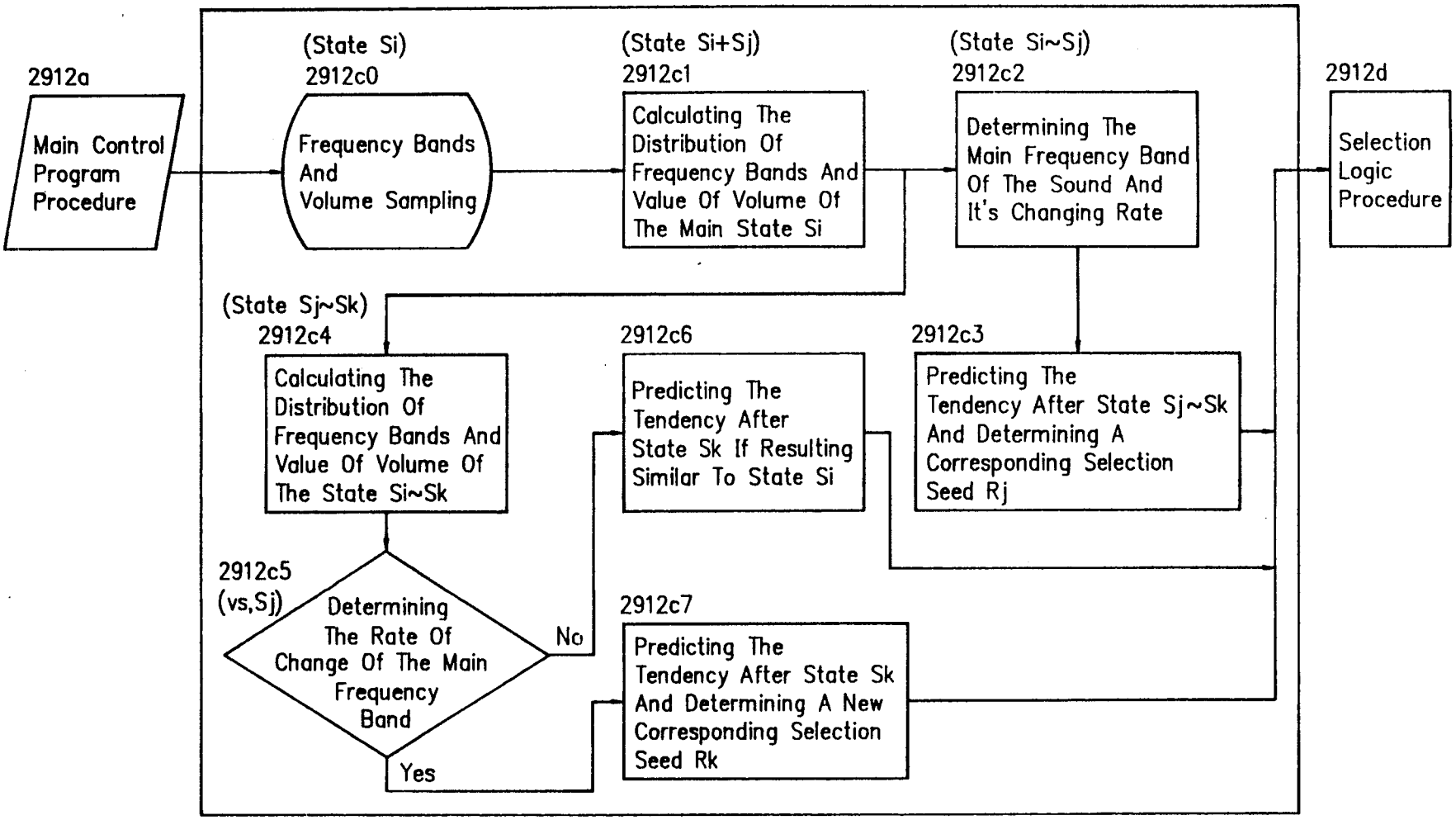
FIG. 2B is a block diagram of the sound tendency determination procedure according to the present invention.

FIG. 2B illustrates the block diagram of the sound tendency determination procedure 2912*c* and the operation of which is outlined hereinafter. Input sound or music instrument analog signal is processed through the sound analyzer circuit 211 into corresponding frequency band and volume digital signal for delivery to the main control program procedure 2912*a* via the TTL input IC 2901. Once the main control program procedure 2912*a* receives the signal, the sound tendency determination procedure 2912*c* starts State Si to sample frequency bands and volume (procedure 2912*c*O) and calculate the distribution of the frequency bands and value of volume of the main State Si (procedure 2912*c*1) for determining the main frequency band of the sound and its changing rate (procedure 2912*c*2) within period of Si to Sj. The so-called main frequency band defined as the frequency band of a sound which has the maximum volume of voice or the higher frequency band of same volume. According to system theory of music analysis composition, the general approach to express and the change of motivation of a work (or voice) can be roughly comprehended through the change and changing rate of the main frequency band. Therefotre, we can roughly predict the possible tendency after State Sj and determine a corresponding selection seed (procedure 2912*c*3) and then send the seed value Ri of selection to the selection logic procedure 2912*d*. Hereby, the value Ri of selection seed designates the value of the emotion of a voice which can be sent to the selection logic procedure 2912*d* for selecting suitable main theme and supporting scenes including spring patterns, main and supporting colors of light, tempo and rhythm of music. The height of spring and intensity of light may be real time reflected according to the volume of voice if deseired.

Since voice state may change after State Sj to State Sk, continuous monitoring procedures must be taken to calculate the distribution of its frequency bands and its volume (procedure 2912*c*4). This new state is compared with State Sj (procedure 2912*c*5) for determining if the main frequency band will stably change to another frequency band within a fixed length of time (5~10 seconds, for example) or the changing speed of the main frequency band is suddenly accelerated or slowed down or stopped. If there is no any unexpected change, it can be predicted that the tendency after State Sk will be simialr to State Si. If there is any unexpected change, the tendency after State Sk is predicted and a corresponding new selection seed Rk is given.

The main feature of this procedure (2912*c*) is to predicate "the long-term tendency" of a voice statistically so as to present the main theme of a voice, and it may also reflect significant sudden change of a voice. Unlike the prior art which can only simply reflect the volume and the rate of speed of a voice randomly, the present invention presents a new approach more closely to human comprehension of music.

Figure 3:
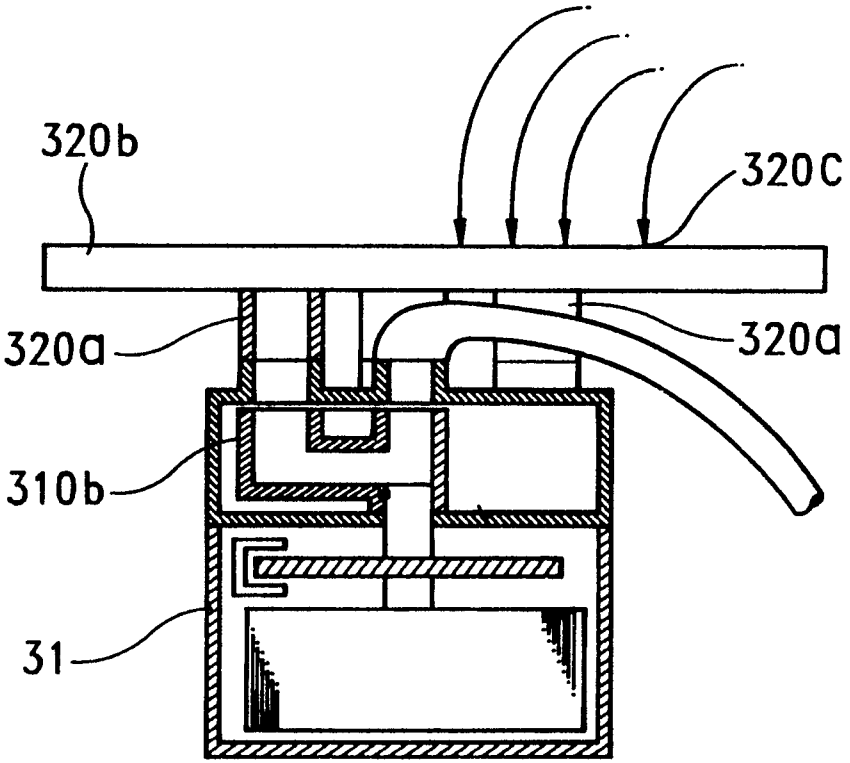
FIG. 3 illustrates the structure of the water performing module according to the present invention.
Figure 3:
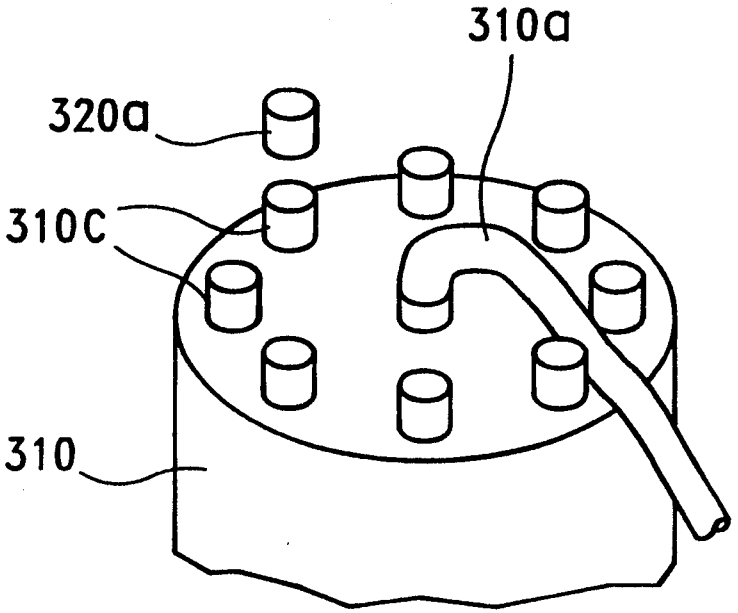

Referring to FIG. 3, therein illustrated is a water performing module 31-32 according to the present invention and generally comprised of a water distribution and level controller 31 and a spring pattern generating unit 32. The small submersible motor 30 is connected to the main circuit unit 20 and controlled by the relay 25 to pump water into the water intake hole 310*a* of the water distribution and level controller 31 from which the distributor 310*b* delivers water through either of the six water outlets 310*c* for supplying water to the corresponding water intake hole 320*a* at the spring pattern generating unit 32 so that water can be further ejected through the corresponding water spout 320*c* to produce a spring. The structure of the water distribution and level controller 31 and the spring pattern generating unit 32 will be outlined further.

In the present invention, the water distribution and level controller 31 has six water outlets 310*c* disposed around a circle and respectively connected to the six parallel water channels 320*b* of the spring pattern generating unit 32. Therefore, various spring patterns at different height can be achieved without using much piping or water nozzles of different angle.

Figure 3B:
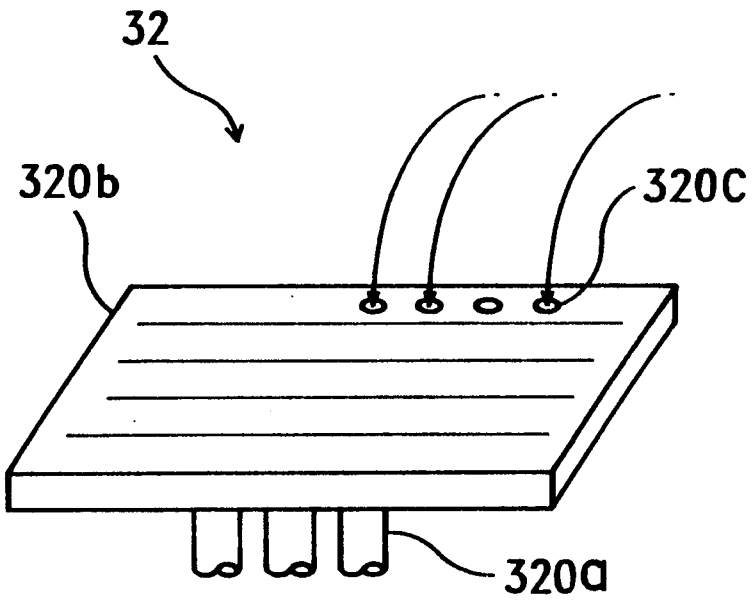
FIG. 3B illustrates the structure of the spring pattern generating unit according to the present invention.
Figure 3A:
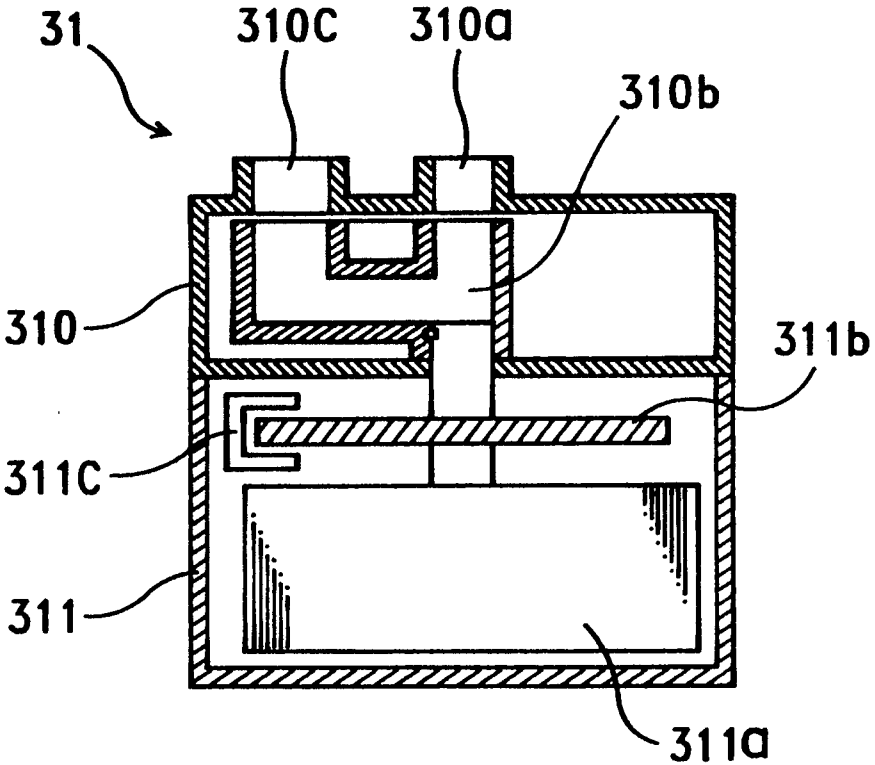
FIG. 3A illustrates the structure of the water distribution and level controller according to the present invention.

FIG. 3A illustrated the structure of the water distribution and level controller 31 which is generally comprises of a distribution box 310 and a synchronous motor box 311. The distribution box 310 has a water intake hole 310*a* at the center the top cover 310*e* thereof, a distributor 310*b* and six water outlets 310*c* at different locations. Water flow quantity is determined according to the relative position of the distributor 310*b* against the six water outlets 310*c* and the relative position of the distributor 310*b* is controlled through different control signal so as to produce different water level. The selection of the water outlets of the distribution box 310 is determined by means of the operation of the motor box 311. The motor box 311 comprises a synchronous motor 311*a* having a locator 311*b* mounted on its motor shaft, which locator 311*b* has a plurality of holes sensed by a photo interrupter 311*c* to provide different signal to an input interface IC 2901. Upon receipt of location signal, the main control procedure 2912*a* controls the synchronous motor 311*a* to drive the distributor 310*b* to a predetermined location for water distribution and flow quantity control.

Therefore, a water pump can now provide several spring patterns and simultaneously control water level through the operation of a simple water distribution and level controller 31. In conventional water performing equipment, a water pump can only provide a single spring pattern and water level must be separately controlled through another measure.

FIG. 3B illustrates the structure of the spring pattern generating unit 32. The spring pattern generating unit 32 is generally comprised of six parallel water channels 320*b* each a water intake hole 320*a* respectively connected to the six water outlets 310*c* of the water distribution and level controller 31 and a plurality of spouts 320*c* disposed at different locations in different angles for producing different spring pattern. Because each water channel has a plurality of spouts disposed at different locations in different angles, modulized water distribution and performance can be conveniently achieved. Conventionally a big scale of spring or an ornamental spring is generally achieved through a plurality of separate water nozzles and a plurality of water supply tubes. In the present invention, water piping can be simplified and no water nozzle is required.

The operation of the light performance sub-system 40 is outlined hereinafter with reference to FIGS. 1 and 2. The relay 26 sends a light control signal to control sixteen lamp bulbs to give off color lighting according to main control procedure software 2912*a*. At least three of the sixteen lamp bulbs are incorporated to produce a specific lighting and the intensity of which is controlled according to the number of lamp bulbs.

In general, the present invention discloses a water performing equipment which provides various spring patterns matching with harmonious color lighting effects through modulized design with extension flexibility.

I claim:

1. A modulized water and light performing equipment, comprising:

a circuit sub-system controlled through either built-in input mode, external sound input mode or external specific input mode to produce a corresponding control signal;

a water performance sub-system controlled by the control signal from said circuit sub-system unit to start or stop a water performing module so as to achieve a predetermined spring pattern and water level, said water performance sub-system further including at least one water performing module formed of a water distribution and level controller and a spring pattern generating unit for producing a plurality of spring patterns and controlling water level, said water distribution and level controller including a locator controlled by a photo interrupter to provide a locating signal for sending a control signal to control a distribution for controlling water distribution through selective ones of a plurality of water outlets and to further control water level;

a light performance sub-system controlled by the control signal from said circuit sub-system unit to produce corresponding color lighting and intensity of light; and wherein said three sub-system are incorporated under different input mode to produce various spring patterns changing at a harmonious rate of speed and rhythm and matching with a variety of harmonious color lighting effects at different intensity.

2. The modulized water and light performing equipment of claim 1, which is further comprised of a bottom box unit and a top box unit, said bottom box unit comprising a powder supply unit, a front control panel and a main circuit unit, said top box unit comprising a water performance sub-system and a light performance sub-system.

3. The water performing module of claim 1, wherein said spring pattern generating unit comprises a plurality of water intake holes respectively connected one-to-one to a plurality of water outlets at said water distribution and level controller, and a plurality of water channels having each a plurality of spouts made at different locations in different angles for producing differrent spring patterns.

4. The water performing module of claim 1, wherein said spring pattern generating unit is comprised of a plurality of straight water supply channels or water supply channels of different shape, arranged in a row and disposed at the same plane or adjacent planes and respectively connected one-to-one to a plurality of water outlets at said water distribution and level controller.

5. The water performing module of claim 1, wherein said water distribution and level controller has a plurality of water outlets around a circle vertically disposed upward or downward or horizontally disposed sidelong.

6. The modulized water and light performing equipment of claim 1, wherein said water performance subsystem further comprises at least one set of water pump for pumping water to one water performing module; and a plurality of sets of water pumps and water performing modules can be arranged at different locations for performance.

7. The modulized water and light performing equipment of claim 2, wherein said top box unit further comprises a water level sensor which sends a feedback signal to said main circuit unit to stop the operation of said water and light performance sub-systems and to give warning signal when the water level at said top box unit is below a fixed range.

8. The modulized water and light performing equipment of claim 1, wherein said light performance subsystem is controlled by the control signal sent from said main current unit, to produce a plurality of color lighting each of which being formed of a plurality of light sources to harmonize with said input modes.

9. The modulized water and light performing equipment of claim 1, wherein said circuit sub-system can receive input signal through built-in input mode to present a harmonious performance combining different spring patterns of different height and different color lighting respectively at different intensity and different rhythm, according to pre-constructed procedures.

10. The modulized water and light performing equipment of claim 1, wherein said circuit sub-system can receive input signal through external sound input mode so as to analyze the frequency and the volume of sound of the received input signal through a sound analyzer circuit, and select a harmonious performance combining different spring patterns of different height and different color lighting respectively at different intensity and different rhythm, by means of the operation of a main control procedure and a sound tendency determination procedure of a main control unit.

11. The modulized water and light performing equipment of claim 1, wherein said circuit sub-system can receive input signal through external specific input mode to convert external digital control signal for controlling said water performing sub-system, or send feedback signal outside.

12. The modulized water and light performing equipment of claim 1, wherein said front control panel of said circuit sub-system comprises input mode selector switch, water performance functional selector switch, light performance functional selector switch and tempo selector switch; photo sensor for dectecting the intensity of ambient light to control said light performance sub-system to operate or stop via a main circuit unit; and at least one diode display for warning of abnormal operation.

13. The modulized water and light performing equipment as recited in claim 1, including a back control panel of said circuit sub-system having an audio input terminal to connect analog signal of external sound to a sound analizer circuit; and a specific signal input terminal to receive external specific digital signal or feed back specific digital signal to an input/output interface unit.

14. The modulized water and light performing equipment as recited in claim 2, including a main circuit unit of said circuit sub-system which comprises:

a sound analyzer unit having a frequency, volume analyzing circuit;

an input interface unit having an input driving IC circuit;

a main control unit having a central processing unit and a read only memory coupled to said sound analyzer unit and said input interface unit for controlled signal output thereto; and an output interface unit having an input IC circuit.

15. The modulized water and light performing equipment of claim 14, wherein the main circuit unit of said circuit sub-system further comprises a plurality of relays or semiconductor switches of same function respectively connected posterior to said output interface unit for controlling said water and light performance sub-systems.

* * * * *